US005528500A

United States Patent [19]

Al-Charif et al.

[11] Patent Number: 5,528,500

[45] Date of Patent: Jun. 18, 1996

[54] PROGRAMMABLE HIGH IDLE SET SWITCH AND METHOD OF OPERATING SAME

[75] Inventors: Yasser A. Al-Charif; David V. Gile, both of Peoria; Amy L. Moore-McKee, Varna, all of Ill.

[73] Assignee: Caterpillar Inc., Peoria, Ill.

[21] Appl. No.: 198,921

[22] Filed: Feb. 18, 1994

[51] Int. Cl.[6] ..... G06G 7/70; F02M 3/00

[52] U.S. Cl. ..... 364/431.01; 364/431.07; 364/431.12; 364/424.03; 123/339.1; 123/327; 123/320; 123/179.16

[58] Field of Search ..... 364/431.01–431.12, 364/424.03, 551.01; 123/339, 179.19, 333, 350, 399, 327, 320, 325, 389, 680, 682, 179.16; 73/118.1, 116

[56] References Cited

U.S. PATENT DOCUMENTS 4,056,082 11/1977 Noiles ..... 123/339
4,478,183 10/1984 Misch et al ..... 123/339
4,651,694 3/1987 Kataoka ..... 123/339
4,883,034 11/1989 Yashiki et al. ..... 364/431.07
5,024,196 6/1991 Ohuchi ..... 123/339
5,024,197 6/1991 Nakamura ..... 364/431.07
5,035,216 7/1991 Sakamoto et al. ..... 364/431.07
5,146,886 9/1992 Männle et al. ..... 123/325
5,161,502 11/1992 Fritz ..... 123/327

*Primary Examiner*—Kevin J. Teska
*Assistant Examiner*—Jacques H. Louis-Jacques
*Attorney, Agent, or Firm*—R. Carl Wilbur

[57] ABSTRACT

An electronic control for controlling a high idle set value of equipment having an engine is disclosed. The control includes an electronic controller electrically connected to a rocker switch comprising a high idle switch and a low idle switch. An engine speed sensor and a decelerator pedal position sensor are electrically connected to the electronic controller. The electronic control permits the equipment operator to program a desired high idle set point value. The control thereafter produces an engine speed command based on the high idle set point value. A decelerator pedal is provided to permit the equipment operator to reduce the engine speed command value below the high idle set point value.

29 Claims, 2 Drawing Sheets

PROGRAMMABLE HIGH IDLE SET SWITCH AND METHOD OF OPERATING SAME

TECHNICAL FIELD OF THE INVENTION

The present invention relates to the field of electronically controlled engines and, more particularly, to electronically controlled engines having a programmable high idle speed and a low idle speed.

BACKGROUND OF THE INVENTION

Bulldozers and other heavy equipment often operate in a series of repeated motions to accomplish a given task. For example, a bulldozer will cycle through load, carry and spread modes to scrape dirt from a work area and move it to another area. During the load mode the bulldozer scrapes dirt from the work area. During the carry mode, the bulldozer moves the dirt to a second location where the dirt is then distributed in the spread mode. Each of these tasks generally requires that the bulldozer operate at relatively high engine speeds. For short periods of time during these cycles, it may be desirable to decrease the engine speed.

Because the equipment runs at high speeds during most of its operations, it is more convenient to cause the engine to operate at higher speeds without an operator input. Then, during those periods when a slower engine speed is desired, the operator can provide an input that will cause the engine to slow down. After the input is removed, the engine will return to the higher speed.

It is known in the prior art to include a mechanical lever connected to the engine to enable the operator to run the engine at a desired engine speed. In connection with the lever, a deceleration pedal is sometimes provided that permits the operator to reduce the engine speed from that initial speed selected by the lever position. In this manner, the operator can cause the engine to run at the higher engine speeds normally required for the given task. Then, operator input is only required during those brief periods when the engine speed must be slowed.

While such prior art systems make the equipment more convenient to operate, they are cumbersome and expensive to build and maintain because of the numerous mechanical connections and linkages. Such systems also require significant space to make all the necessary mechanical connections and are also difficult to repair. Moreover, it is difficult to detect a malfunction in such systems. Such systems do not provide a default high idle position that can be easily and repeatably selected.

The present invention is directed toward overcoming one or more of the disadvantages of the prior art.

SUMMARY OF THE INVENTION

In one aspect of the present invention, an apparatus for programmably controlling a high idle speed of an engine is disclosed. The apparatus includes an electronic controller electrically connected to an engine speed sensor, where the engine speed sensor produces an engine speed signal. A high idle switch is electrically connected to the electronic controller. A high idle set point is produced as a function of the high idle switch. The electronic controller produces an engine speed command corresponding to said high idle set point in response to said high idle switch being moved to a closed position.

In another aspect of the present invention, a method of operating equipment having an electronically controlled engine is disclosed. The equipment includes an electronic controller, memory means connected to the electronic controller having stored therein a high idle default value, a high idle set point and a low idle set point. The equipment further includes a high idle switch having an open and closed position, a low idle switch having an open and closed position, an engine speed sensor, and a decelerator pedal having a plurality of positions. The decelerator pedal is connected to a position sensor. The method comprises the steps of sensing the position of said high idle switch, setting the high idle set point to the high idle default value in response to the high idle switch being in a closed position and producing an engine speed command as a function of the high idle set point.

These and other aspects and advantages of the present invention will become apparent upon reading the detailed description of the preferred embodiment in connection with the appended drawings and claims.

DETAILED DESCRIPTION OF THE PREFERRED EMBODIMENT

Figure 1:
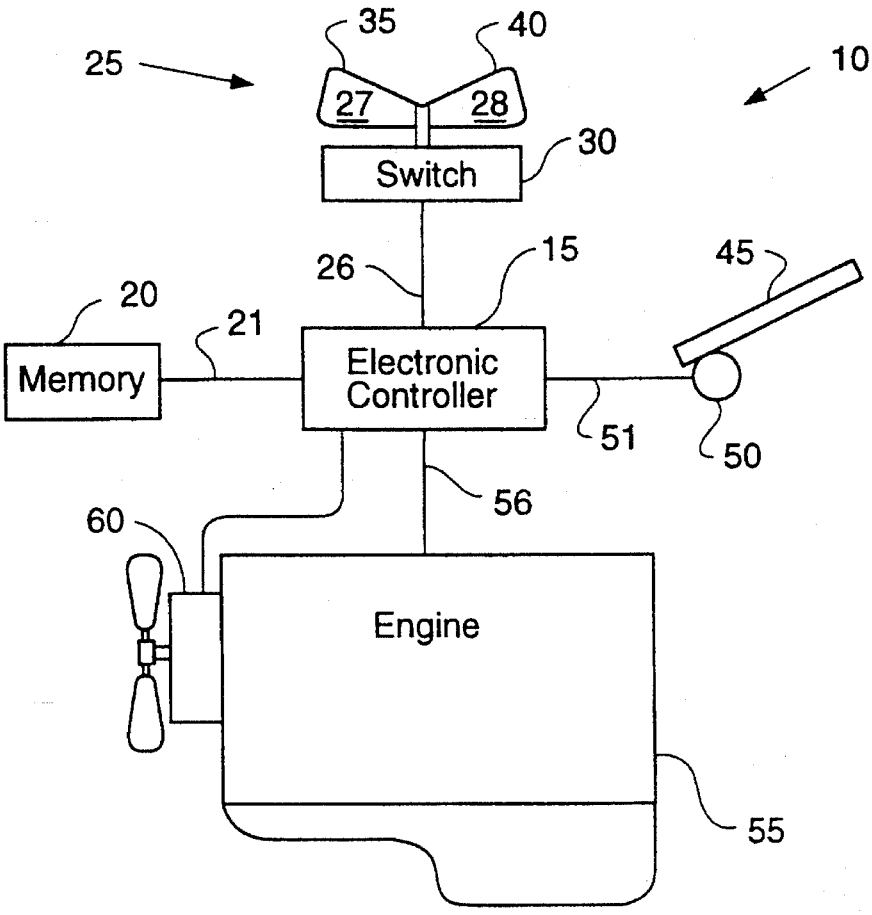
FIG. 1 is a schematic diagram of a preferred embodiment of the present invention.

Referring to FIG. 1, a schematic diagram of an embodiment of the engine control 10 of present invention is shown. The engine control 10 includes an electronic controller 15 which is connected to a memory device 20. Although the memory device 20 is shown as a distinct element, electronic controllers that have memory within the controller are known in the art. Such controllers could be readily and easily substituted without deviating from the scope of the present invention. As shown in FIG. 1, the memory device 20 is connected to the electronic controller by an electrical connector 21. As is known in the art, the software control of the electronic controller 15 is stored in the memory device 20 as are variables and other constants that may be used. The software control is described more fully below with reference to FIG. 2.

A switch 25 is connected to the electronic controller 15 by an electrical connector 26. The switch 26 preferably includes a three position rocker type momentary switch 30 which is normally biased to a center position. Such rocker switches 30 normally have a right, center, and left position. In an embodiment of the present invention, the left portion 27 of the rocker switch 30 is referred to as a low idle switch 35 and the right portion 28 of the rocker switch 40 is referred to as a high idle switch 40. The high idle switch 40 and the low idle switch 35 can be positioned in an open or a closed position. When the rocker switch is in the center position, both the high idle switch 40 and the low idle switch 35 are in an open position. When an operator presses the left portion 27 of the rocker switch 30, the low idle switch 35 moves to the closed position and the high idle switch 40 remains in an open position. When the operator releases the switch, the rocker returns to the center position. Conversely, when an operator presses the right portion 40 of the rocker switch 30, the high idle switch 40 moves to a closed position and the low idle switch 35 moves to an open position.

Figure 1A:
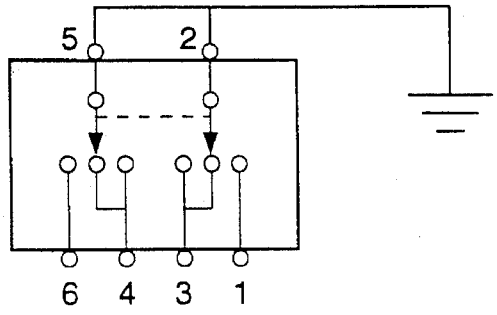
FIG. 1*a* is a schematic drawing of a preferred embodiment of a switch shown in FIG. 1.

Although only one line is used to represent the electrical connector 26 in FIG. 1, it should be recognized that such line will normally represent more than a single electrical connection. In a preferred embodiment including a high idle switch 40 and a low idle switch 35, the rocker switch 30 controls current flowing in two pairs of electrical connectors. In this manner, the rocker switch can produce signals corresponding to the combinations of open and closed positions for the high idle switch 40 and low idle switch 35 described above. Many different combinations of signals can represent the combination of open and closed positions for the high idle switch 40 and the low idle switch 35. The specific signals in the two pairs of electrical connectors are a matter of design preference. However, in a preferred embodiment, the rocker switch 30 configuration is as shown in FIG. 1*a*. The outputs for the rocker switch are as follows:

| Switch Position | 1 | 3 | 4 | 6 |
|---|---|---|---|---|
| Center Position | H | L | L | H |
| Right Portion Pressed | H | L | H | L |
| Left Portion Pressed | L | H | L | H |

As shown in FIG. 1*a*, the output pins 2,5 are tied to ground. Internal to the electronic controller 15 are pull up resistors that cause the output pins 1,3,4,6 to produce a high signal (H) unless the pin is tied to ground. Although a preferred embodiment of the present invention uses the switch configuration shown in FIG. 1*a*, other pin configurations and combinations of output signals are known in the art. Any of the known configurations could be readily and easily substituted without deviating from the scope of the present invention as defined by the appended claims.

Although this embodiment of the present invention is described in connection with the high idle switch 40 and the low idle switch 35 comprising a single rocker switch 30, other switches could be readily and easily substituted without deviating from the scope of the present invention as defined by the appended claims. For example, it is possible to provide two individual momentary switches, a first switch representing the high idle switch 40 and the second representing the low idle switch 35.

A decelerator pedal 45 is attached to a position sensor 50. The position sensor 50 outputs a decelerator position signal over an electrical connector 51. Many suitable position sensors are known in the art. In a preferred embodiment, the position sensor 50 takes the form of the sensor disclosed in Brown, U.S. Pat. No. 4,915,075. The electronic controller 15 inputs the decelerator pedal position signal over the electrical connector 51.

The electronic controller 15 is connected to an engine 55 by a connector 56. The electronic controller 15 calculates an engine speed command based on certain engine parameters and operator inputs and calculates a fuel delivery command that is delivered to fuel injectors or other fuel delivery means over the connector 56. Such calculations, and issuing a fuel delivery command based on engine parameters and operator inputs, are well known in the art and therefore will not be described further. An engine speed sensor 60 is connected to the engine 55 and produces an engine speed signal that is a function of the engine speed. The engine speed sensor 60 is connected to the electronic controller 15 by an electrical connector 61 over which the engine speed signal is delivered to the electronic controller 15. Many suitable engine speed sensors are known in the art. In a preferred embodiment, the engine speed sensor takes the form of the sensor disclosed in U.S. Pat. No. 4,972,332 issued to Luebbering et al.

Figure 2:
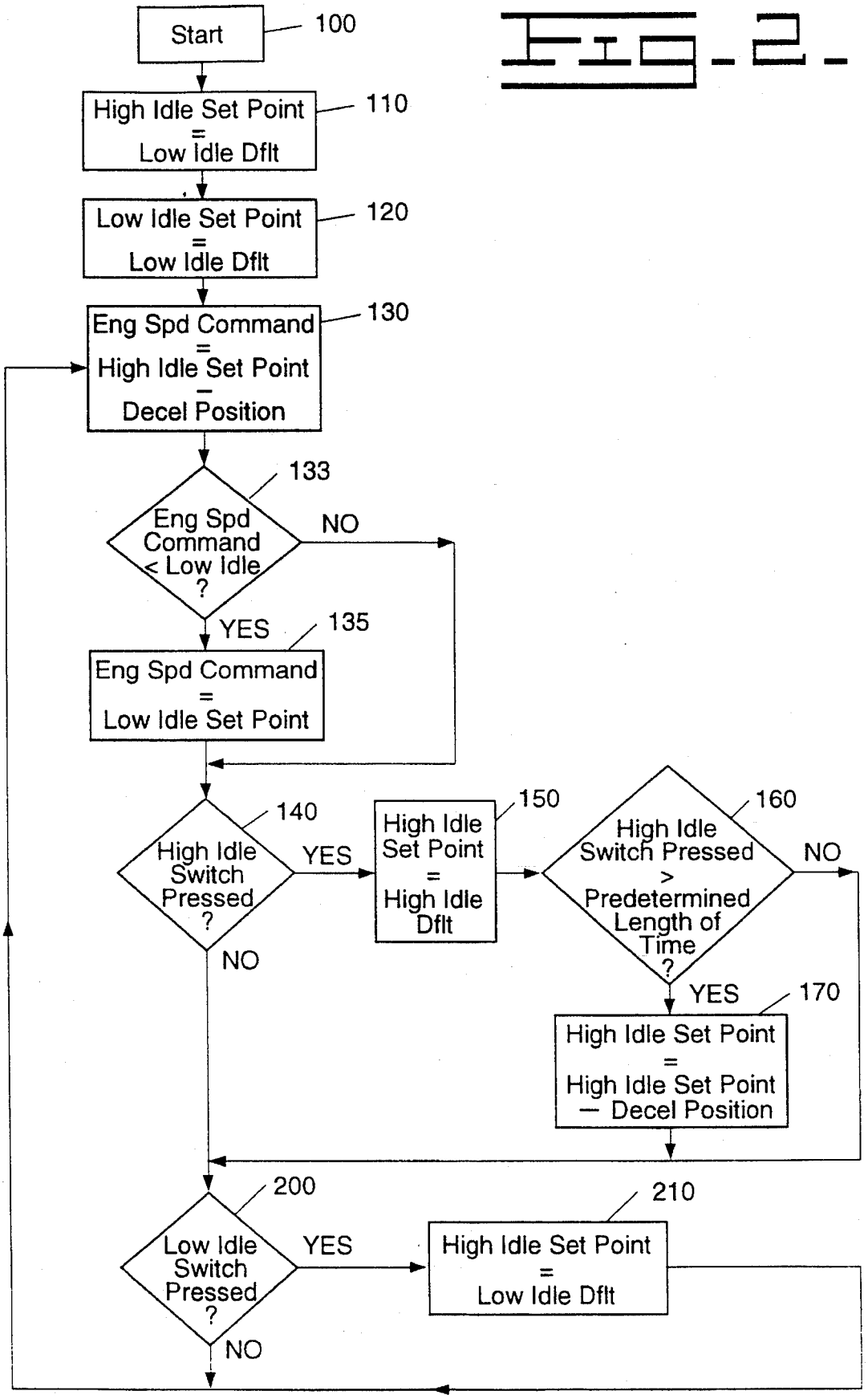
FIG. 2 is a flowchart of an embodiment of the software control used in connection with the embodiment depicted in FIG. 1.

Referring now to FIG. 2, a detailed flowchart of the software control of an embodiment of the present invention is shown. In a preferred embodiment, the electronic controller 15 is a 68HC11 microcontroller manufactured by Motorola, Inc. located in Schaumberg, Ill. However, other suitable microcontrollers are known in the art, any one of which could be readily and easily used in connection with this embodiment of the present invention. Those skilled in the art can readily and easily write the specific program code from the detailed flowchart, shown in FIG. 2, using the specific assembly language or microcode for the selected microcontroller.

In block 100, program control of this embodiment of the present invention begins. Program control passes to block 110. In block 110, the electronic controller 15 sets the variable HIGH IDLE SET POINT to a default value, LOW IDLE DFLT, stored in memory 20. In a preferred embodiment, the LOW IDLE DFLT value corresponds to an engine speed value of approximately 650 revolutions per minute. However, other values could be readily and easily used without deviating from the scope of the present invention as defined by the appended claims. Program control passes from block 110 to block 120.

In block 120, the electronic controller 15 sets the variable LOW IDLE SET POINT to the default value LOW IDLE DFLT that is stored in memory 20. As noted above, in a preferred embodiment, the LOW IDLE DFLT corresponds to an engine speed of approximately 650 revolutions per minute. However, other values could be readily and easily used without deviating from the scope of the present invention. Program control then passes to block 130.

In block 130, the electronic controller 15 produces an engine speed command that is a function of the difference between the HIGH IDLE SET POINT and the decelerator pedal position signal. The decelerator pedal position signal allows the operator to temporarily adjust the engine speed command to value lower than the HIGH IDLE SET POINT by pressing the decelerator pedal. Thus, the operator may set the HIGH IDLE SET POINT (described below) to a value corresponding to an engine speed at which the equipment will normally be operated. The engine speed command will remain at that value so long as the decelerator pedal is not pressed (i.e. the decelerator pedal position signal is substantially zero). As is known in the art, the engine speed command is then used, in combination with other engine parameters and inputs, to calculate the fuel delivery command delivered to the engine 55 over connector 56. Program control passes from block 130 to block 133.

In block 133, the electronic controller compares the engine speed command to the LOW IDLE DFLT value. If the engine speed command calculated in block 130 is less than the LOW IDLE DFLT value, then program control passes to block 135. Otherwise, program control passes to block 140.

In block 135, the engine speed command is set to a speed corresponding to the LOW IDLE DFLT. Thus, the LOW IDLE DFLT is a minimum value for the engine speed command and the operator cannot command an engine speed below that value. From block 135, program control passes to block 140.

In block 140, the electronic controller 15 reads the high idle switch 40 to determine whether the operator has depressed the switch thereby forcing it to a closed position. If the high idle switch 40 has been pressed, then program control passes to block 150, otherwise program control passes to block 200.

In block 150, the electronic controller sets the HIGH IDLE SET POINT variable to the default value HIGH IDLE DFLT. In a preferred embodiment, the HIGH IDLE DFLT value corresponds to an engine speed of about 1980 revolutions per minute. However, other values can be readily and easily used without deviating from the spirit and scope of the present invention as defined by the appended claims. Program control then passes to block 160.

In block 160, the electronic controller 15 monitors the high idle switch 40 to determine whether the switch 40 has remained in a closed position for more than a predetermined length of time. In a preferred embodiment, the predetermined length of time is about three seconds. However, other values could readily and easily be used in connection with this embodiment without deviating from the spirit and scope of the present invention as defined by the appended claims. By pressing the high idle switch 40 for more than the predetermined length of time, the equipment operator is able to reprogram the HIGH IDLE SET POINT value. As described above, the engine speed command is determined, in part, as a function of the HIGH IDLE SET POINT. Thus, by reprogramming the HIGH IDLE SET POINT, the operator will affect the engine speed command. If the high idle switch has been pressed for more than the predetermined length of time, program control passes to block 170, otherwise program control passes to block 200.

In block 170, the electronic controller 15 reads the decelerator pedal position signal on connector 51. The electronic controller then reprograms the HIGH IDLE SET POINT value as a function of the difference between the previous HIGH IDLE SET POINT and the decelerator pedal position signal at the time when the high idle switch is released. In this manner, by pressing the high idle switch for more than the predetermined length of time and by pressing the decelerator pedal, the operator can reprogram the HIGH IDLE SET POINT to a value less than the HIGH IDLE DFLT value. Once the HIGH IDLE SET POINT variable is reprogrammed, program control passes to block 200.

In block 200, the electronic controller 15 reads the position of the low idle switch 35. If the low idle switch is in a closed position, then program control passes to block 210, otherwise program control passes to block 130.

In block 210, the HIGH IDLE SET POINT is reprogrammed to the LOW IDLE DFLT value. Program control then passes to block 130. In block 130, the electronic controller 15 produces an engine speed command as described above.

Industrial Applicability

When the operator initially starts the equipment, the electronic controller 15 will calculate an engine speed command as a function of the LOW IDLE DFLT value. In the preferred embodiment, the engine speed will correspond to about 650 revolutions per minute.

If the operator then desires to operate the equipment at an engine speed corresponding to the HIGH IDLE DFLT value, the operator will momentarily press the high idle switch 40 for less than the predetermined length of time. The engine speed command will then initially correspond to the HIGH IDLE DFLT value. In a preferred embodiment, the HIGH IDLE DFLT is about 1980 revolutions per minute and thus engine speed will climb to approximately 1980 RPM. The operator can momentarily decrease the engine speed below 1980 revolutions per minute by pressing the decelerator pedal 45. If, on the other hand, the operator wants to continuously operate the vehicle at a lower speed, it would be more convenient to reprogram the HIGH IDLE SET POINT value than to keep the decelerator pedal 45 fixed in a certain position. The operator will then press the high idle switch 40 for more than the predetermined length of time, and simultaneously press the decelerator pedal 45 to a position corresponding to the desired speed. When the operator releases the high idle switch 40, the electronic controller 15 reprograms the HIGH IDLE SET POINT to that new value. The engine speed command will then correspond to that desired value so long as the decelerator pedal 45 is not depressed. As described above, the operator can momentarily reduce the engine speed command from the HIGH IDLE SET POINT value by pressing the decelerator pedal 45.

When the operator wants the equipment to operate at low idle, the operator presses the low idle switch 35. Then, the engine speed command will be set to the LOW IDLE DFLT value. In a preferred embodiment, the engine speed command will correspond to a value of approximately 650 revolutions per minute and the engine speed will be reduced to that level.

We claim:

1. An apparatus for programmably controlling a high idle speed of an engine, said apparatus comprising;

an electronic controller;

an engine speed sensor electrically connected to said electronic controller, said engine speed sensor producing an engine speed signal as a function of the rotational speed of the engine;

a high idle switch electrically connected to said electronic controller, said high idle switch having an open and a closed position and wherein said high idle switch is a momentary switch;

memory means connected to said electronic controller;

a low idle default value stored in memory;

a low idle switch having an open and closed position, said low idle switch being electrically connected to said electronic controller and wherein said low idle switch is a momentary switch;

a high idle set point stored in said memory means;

a decelerator pedal being positionable in a plurality of positions;

a position sensor connected to said decelerator pedal and electrically connected to said electronic controller, said position sensor producing a decelerator pedal position signal as a function of the position of said decelerator pedal;

wherein said electronic controller sets said high idle set point to a high idle default value in response to said high idle switch being moved to a closed position and produces an engine speed command corresponding to said high idle set point;

wherein said electronic controller sets said high idle set point to said low idle default value in response to said low idle switch being moved to said closed position; and wherein said electronic controller calculates a reprogrammed high idle set point in response to said high idle switch being held in said closed position for greater than a predetermined length of time, said reprogrammed high idle set point being a function of the high idle set point and said decelerator position signal.

2. An apparatus according to claim 1, wherein said electronic controller produces said engine speed command as a function of said high idle set point and said decelerator position signal and wherein said predetermined length of time corresponds approximately to three seconds.

3. An apparatus for programmably controlling a high idle speed of an engine, said apparatus comprising:

an electronic controller;

an engine speed sensor electrically connected to said electronic controller, said engine speed sensor producing an engine speed signal as a function of the rotational speed of the engine;

a high idle switch electrically connected to said electronic controller, said high idle switch having an open and a closed position and wherein said high idle switch is a momentary switch;

memory means connected to said electronic controller;

a high idle set point stored in said memory means;

a low idle default value stored in memory;

a low idle switch having an open and closed position, said low idle switch being electrically connected to said electronic controller and wherein said low idle switch is a momentary switch;

a decelerator pedal having a plurality of positions;

a position sensor connected to said decelerator pedal and electrically connected to said electronic controller, said position sensor producing a decelerator pedal position signal as a function of the position of said decelerator pedal;

wherein said low idle switch and said high idle switch comprise a three position momentary rocker switch, said switch having a center position, a left position, and a right position and wherein said high idle switch is in said closed position and said low idle switch is in said open position, when said momentary rocker switch is in said right position, said high idle switch and said low idle switch are in said open, and positions when said rocker switch is in said center position said high idle switch is said open position and said low idle switch is said closed position when said momentary rocker switch is in said left position;

wherein said electronic controller sets said high idle set point to said low idle default value in response to said low idle switch being moved to said closed position;

wherein said electronic controller sets said high idle set point to a high idle default value in response to said high idle switch being moved to a closed position and produces an engine speed command corresponding to said high idle set point; and wherein said electronic controller calculates a reprogrammed high idle set point in response to said high idle switch being held in a closed position for greater than a predetermined length of time, said reprogrammed high idle set point being a function of the high idle set point and said decelerator position signal.

4. An apparatus according to claim 3, wherein said electronic controller produces said engine speed command as a function of said high idle set point and said decelerator pedal position signal; and wherein said predetermined length of time corresponds approximately to three seconds.

5. A method of operating equipment having an electronically controlled engine, said equipment including an electronic controller, memory means connected to said electronic controller having stored therein a high idle default value, a high idle set point and a low idle default value, said equipment including a high idle switch having an open and closed position, a low idle switch having an open and closed position, an engine speed sensor, and a decelerator pedal having a plurality of positions, said decelerator pedal being connected to a position sensor, said position sensor being connected to said electronic controller, said method comprising the steps of:

sensing the position of said high idle switch;

setting said high idle set point to said high idle default value in response to said high idle switch being in a closed position for less than a predetermined length of time;

reprogramming said high idle set point in response to said high idle switch being in a closed position for more than a predetermined length of time, wherein said reprogrammed high idle set point is a function of the high idle set point and the position of said deceleration pedal;

sensing the position of said low idle switch;

setting said high idle set point to a value corresponding to said low idle default in response to said low idle switch being moved to a closed position for less than a predetermined length of time; and producing an engine speed command as a function of said high idle set point.

6. The method according to claim 5, including the steps of:

sensing the position of said low idle switch;

producing an engine speed command as a function of said low idle default value in response to said low idle switch momentarily being in a closed position; and setting said high idle set point to said high idle default value.

7. An apparatus for programmably controlling a high idle speed of an engine, said apparatus comprising:

an electronic controller;

an engine speed sensor electrically connected to said electronic controller, said engine speed sensor producing an engine speed signal as a function of the rotational speed of the engine;

a high idle switch electrically connected to said electronic controller, said high idle switch having an open and a closed position;

memory means connected to said electronic controller;

a high idle set point stored in said memory means; and wherein said electronic controller sets said high idle set point to a high idle default value in response to said high idle switch being moved to a closed position for less than a predetermined length of time, sets the high idle set point to a value that is a function of engine speed in response to said high idle switch being moved to a closed position for greater than a predetermined length of time, and produces an engine speed command corresponding to said high idle set point.

8. An apparatus according to claim 7, including:

a low idle default value stored in memory;

a low idle switch having an open and closed position, said low idle switch being electrically connected to said electronic controller; and wherein said electronic controller sets said high idle set point to said low idle default value in response to said low idle switch being moved to said closed position.

9. An apparatus according to claim 8, wherein said predetermined length of time corresponds approximately to three seconds.

10. An apparatus according to claim 9, wherein said high idle switch is a momentary switch.

11. An apparatus according to claim 10, wherein said high idle switch is a momentary switch.

12. An apparatus according to claim 11, wherein said low idle switch is a momentary switch.

13. An apparatus according to claim 12, wherein said low idle switch and said high idle switch comprise a three position momentary rocker switch, said switch having a center position, a left position, and a right position.

14. An apparatus according to claim 13, wherein:

said high idle switch is in said closed position and said low idle switch is said open position when said momentary rocker switch is in said right position;

said high idle switch and said low idle switch are in said open positions when said rocker switch is in said center position;

said high idle switch is said open position and said low idle switch is said closed position when said momentary rocker switch is in said left position.

15. An apparatus for programmably controlling a high idle speed of an engine, said apparatus comprising:

an electronic controller;

an engine speed sensor electrically connected to said electronic controller, said engine speed sensor producing an engine speed signal as a function of the rotational speed of the engine;

a high idle switch electrically connected to said electronic controller, said high idle switch having an open and a closed position;

memory means connected to said electronic controller;

a decelerator pedal having a plurality of positions;

a position sensor connected to said decelerator pedal and electrically connected to said electronic controller, said position sensor producing a decelerator pedal position signal as a function of a position of said decelerator pedal a high idle set point stored in said memory means; and wherein said electronic controller sets said high idle set point to a high idle default value in response to said high idle switch being moved to a closed position for less than a predetermined length of time, sets the high idle set point to a value that is a function of engine speed and the decelerator pedal position signal in response to said high idle switch being moved to a closed position for greater than a predetermined length of time, and produces an engine speed command corresponding to said high idle set point.

16. An apparatus according to claim 15, including:

a low idle default value stored in memory;

a low idle switch having an open and closed position, said low idle switch being electrically connected to said electronic controller; and wherein said electronic controller sets said high idle set point to said low idle default value in response to said low idle switch being moved to said closed position.

17. An apparatus according to claim 16, wherein said electronic controller produces said engine speed command as a function of said high idle set point and said decelerator position signal.

18. An apparatus according to claim 17, wherein said predetermined length of time corresponds approximately to three seconds.

19. An apparatus according to claim 18, wherein said high idle switch is a momentary switch.

20. An apparatus according to claim 19, wherein said high idle switch is a momentary switch.

21. An apparatus according to claim 20, wherein said low idle switch is a momentary switch.

22. An apparatus according to claim 21, wherein said low idle switch and said high idle switch comprise a three position momentary rocker switch, said switch having a center position, a left position, and a right position.

23. An apparatus according to claim 22, wherein;

said high idle switch is in said closed position and said low idle switch is said open position when said momentary rocker switch is in said right position;

said high idle switch and said low idle switch are in said open positions when said rocker switch is in said center position;

said high idle switch is said open position and said low idle switch is said closed position when said momentary rocker switch is in said left position.

24. An apparatus for use on a vehicle having an engine, said apparatus permitting a vehicle operator to program an elevated engine speed, comprising:

an electronic controller;

memory means connected to said electronic controller;

a high idle set point stored in said memory means;

a high idle switch having a first and second position connected to said electronic controller; and wherein said electronic controller issues an engine speed command corresponding to said high idle set point in response to said high idle switch being moved to said second position.

25. An apparatus according to claim 24, wherein:

said electronic controller measures a first time period, said first time period corresponding to a period of time during which said high idle switch is in said second position; and said electronic controller changes the value of said high idle set point as a function of said first time period.

26. An apparatus according to claim 25, wherein said change in said high idle set point is a decrease in high idle set point.

27. An apparatus according to claim 24, including:

a pedal;

a pedal position sensor connected to said electronic controller, said pedal position sensor producing a pedal position signal; and wherein said electronic controller issues an engine speed command as a function of said high idle set point and said pedal position signal.

28. An apparatus according to claim 27, wherein:

said electronic controller measures a first time period, said first time period corresponding to a period of time during which said high idle switch is in said second position; and said electronic controller changes the value of said high idle set point as a function of said first time period.

29. An apparatus according to claim 24, including:

a low idle switch having a first and a second position, said low idle switch being connected to said electronic controller;

a low idle set point stored in said memory means; and wherein said electronic controller issues an engine speed command corresponding to said low idle switch is moved to said second position.

* * * * *